US009403372B2

(12) United States Patent
Taff et al.

(10) Patent No.: US 9,403,372 B2
(45) Date of Patent: Aug. 2, 2016

(54) FLUID EJECTION DEVICE WITH ACEO PUMP

(75) Inventors: Brian M. Taff, Corvallis, OR (US); Sadiq Bengali, Corvallis, OR (US); Greg Scott Long, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,107

(22) PCT Filed: Feb. 28, 2012

(86) PCT No.: PCT/US2012/026855

§ 371 (c)(1),
(2), (4) Date: Jul. 23, 2014

(87) PCT Pub. No.: WO2013/130039

PCT Pub. Date: Sep. 6, 2013

(65) Prior Publication Data

US 2015/0070446 A1 Mar. 12, 2015

(51) Int. Cl.

| | |
|---|---|
| ***B41J 2/175*** | (2006.01) |
| ***B41J 2/14*** | (2006.01) |
| ***B41J 29/38*** | (2006.01) |
| ***B41J 29/393*** | (2006.01) |

(52) U.S. Cl.

CPC ..... *B41J 2/17596* (2013.01); *B41J 2/1404* (2013.01); *B41J 29/38* (2013.01); *B41J 29/393* (2013.01); *B41J 2002/14467* (2013.01)

(58) Field of Classification Search

CPC ..... B41J 2/04526; B41J 2/14096; B41J 2/18; B41J 2/005

USPC ..... 347/65, 92, 89

See application file for complete search history.

(56) References Cited

U.S. PATENT DOCUMENTS

| | | | | |
|---|---|---|---|---|
| 5,666,148 | A | 9/1997 | Kitamura | |
| 6,059,399 | A | 5/2000 | Suetsugu et al. | |
| 6,172,693 | B1 | 1/2001 | Minemoto et al. | |
| 6,244,694 | B1 * | 6/2001 | Weber et al. | 347/65 |
| 6,786,955 | B2 | 9/2004 | Kabalnov | |
| 7,377,622 | B2 | 5/2008 | Nakazawa | |
| 7,427,124 | B2 | 9/2008 | Kusakari | |
| 2008/0000772 | A1 * | 1/2008 | Bazant et al. | 204/450 |

FOREIGN PATENT DOCUMENTS

| | | | |
|---|---|---|---|
| JP | 2001-205810 | A | 7/2001 |
| WO | 2011-146149 | A1 | 11/2011 |

OTHER PUBLICATIONS

International Search Report and Written Opinion for International Application No. PCT/US2012/026855 dated Oct. 23, 2012, 9 pp.

* cited by examiner

*Primary Examiner* — Juanita D Jackson

(57) ABSTRACT

In an embodiment, a fluid ejection device includes a fluidic channel having first and second ends and a drop generator disposed within the channel. A fluid reservoir is in fluid communication with the first and second ends of the channel, and an alternating-current electro-osmotic (ACEO) pump is disposed within the channel to generate net fluid flow from the reservoir at the first end, through the channel, and back to the reservoir at the second end.

17 Claims, 5 Drawing Sheets

FLUID EJECTION DEVICE WITH ACEO PUMP

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

As nozzles sit exposed to ambient atmospheric conditions while in idle non-jetting states, evaporative water loss through the nozzle bores can alter the local composition of ink volumes within the bores, the firing chambers, and in some cases, beyond an inlet pinch toward the shelf/trench (ink slot) interface. Following periods of nozzle inactivity, the variation in properties of these localized volumes can modify drop ejection dynamics (e.g., drop trajectories, velocities, shapes and colors). This lag in nozzle renewal capabilities and the associated effects on drop ejection dynamics following non-jetting periods is referred to as decap response. Continued improvement of inkjet printers and other fluid ejection systems relies in part on mitigating decap response issues.

BRIEF DESCRIPTION OF THE DRAWINGS

The present embodiments will now be described, by way of example, with reference to the accompanying drawings, in which.

DETAILED DESCRIPTION

Overview

Figure 1:
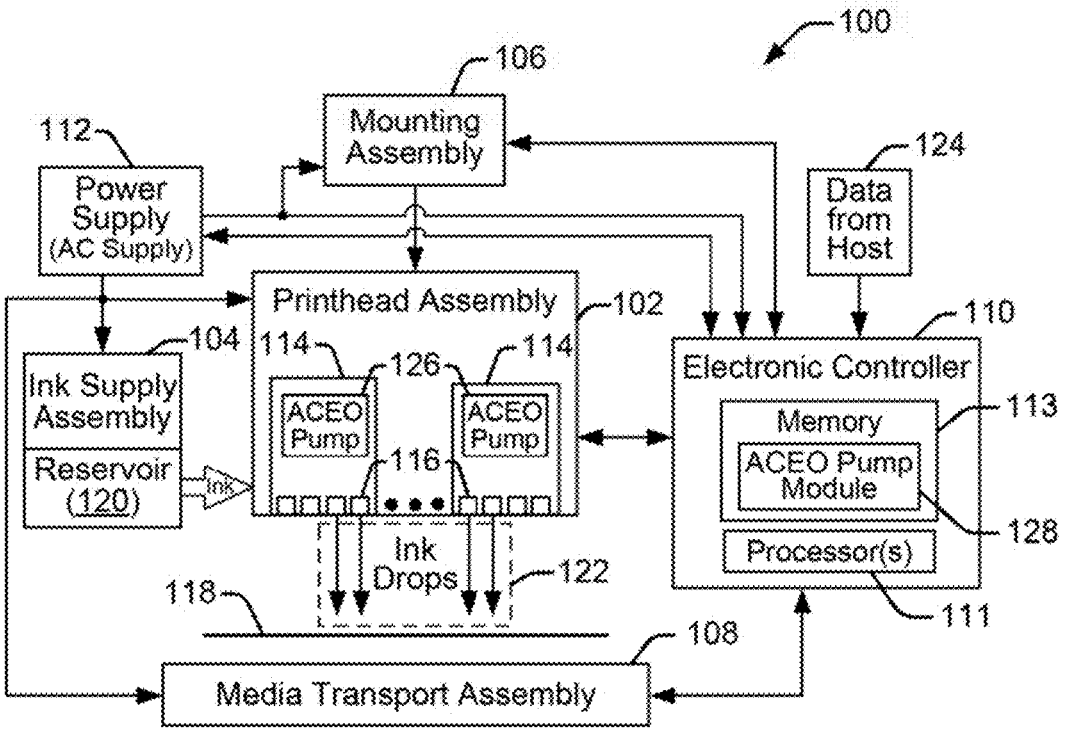
FIG. 1 shows a fluid ejection system implemented as an inkjet printing system, according to an embodiment.

As noted above, the decap response impacts stagnant ink volumes local to the nozzle bores, firing chambers, and other nearby areas within fluid ejection devices that interface with the surrounding environment during non-jetting idle spans. In general, decap behaviors tend to manifest in the form of Pigment Ink Vehicle Separation (PIVS) and viscous plug dependent modes. This dynamic can adversely impact drop ejection behaviors such as drop trajectories, drop velocities, drop shapes and even drop colors. Prior methods of mitigating the decap response have focused mostly on ink formulation chemistries, minor architecture adjustments, tuning nozzle firing parameters, and/or servicing algorithms. These approaches have often been directed toward specific printer/platform implementations, however, and have therefore not provided a universally suitable solution.

Efforts to mitigate the decap response through adjustments in ink formulation, for example, often rely upon the inclusion of key additives that offer benefits only when paired with specific dispersion chemistries. Architecture focused strategies have typically leveraged shortened shelves (i.e., the length from the center of the firing resistor to the edge of the incoming ink-feed slot) and modifications to nozzle diameters and resistor sizes. These techniques, however, usually provide only minimal performance gains. Fire pulse routines have shown some improvements in targeted architectures when exercised as sub-TOE (turn on energy) mixing protocols for stirring ink within the nozzle to combat Pigment Ink Vehicle Separation (PIVS) forms of the decap dynamic, or by delivering more energetic stimulation of in-chamber ink volumes (delivered at higher voltages or through modified precursor pulse configurations) to compete against viscous plugging forms of the decap response. Again, however, this strategy provides only marginal gains in specific non-universal contexts. Servicing algorithms have functioned as the main systems-based fix. However, servicing algorithms typically generate waste ink and associated waste ink storage issues, in-printer aerosol, and print/wipe protocols that are only feasible for implementation as pre- or post-job exercises.

Embodiments of the present disclosure mitigate the decap response more generally through the use of an alternating current electro-osmotic (ACEO) pump mechanism that generates a net flow of fluid within a micro-fluidic environment. The ACEO pump involves the use of stepped (3-dimensional) electrodes having inter-digitated ladder topologies, where interleaved electrode "fingers" are driven with opposite polarity (i.e., 180 out of phase). The disclosed embodiments provide an effective pumping technique for flushing fresh ink from a bulk supply (e.g., the trench/ink slot) through the firing chamber to improve the quality of the ejected drop output. The pumping technique does not involve the formation of a steam bubble or depend on surrounding micro-channel asymmetries. In addition, the technique does not generate a pulsed flow, which avoids introducing additional, unwanted nozzle puddling and cross-talk between nozzles, and enables a continual pumping operation that is independent of nozzle fire sequencing (i.e., jetting events). Other advantages include less waste ink from servicing and a related reduction in the amount of servicing hardware.

In one example embodiment, a fluid ejection device includes a fluidic channel having first and second ends. A drop generator is disposed within the channel, and a fluid reservoir is in fluid communication with the first and second ends of the channel. An alternating-current electro-osmotic (ACEO) pump is disposed within the channel to generate net fluid flow from the reservoir at the first end, through the channel, and back to the reservoir at the second end. In one implementation, the ACEO pump includes a plurality of electrodes on the floor of the channel, where each electrode extends lengthwise across the width of the channel and is orthogonal to the direction of the net fluid flow. A first group of electrodes coupled to a first terminal of an AC power source is interleaved in an alternating manner with a second group of electrodes coupled to a second terminal of the AC power source.

In another example embodiment, a processor-readable medium stores code representing executable instructions. When executed by the processor, the instructions cause the processor to apply opposite electrical polarities to adjacent electrodes within a fluidic channel. The fluidic channel includes a nozzle and a chamber, and the electrodes comprise interdigitated, 3-dimensional electrodes, each having a stepped region and a non-stepped region. The instructions further cause the processor to repeatedly switch the electrical polarities applied to each electrode to generate a net fluid flow through the channel. The instructions further cause the processor to eject fluid through the nozzle as it flows through the chamber.

Illustrative Embodiments

FIG. 1 illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. In some implementations, power supply 112 can include an AC power supply to supply AC power to ACEO (alternating current electroosmotic) pump mechanisms 126 within fluid ejection devices 114. In this embodiment, fluid ejection devices 114 are implemented as fluid drop jetting printheads 114. Inkjet printhead assembly 102 includes at least one fluid drop jetting printhead 114 that ejects drops of ink through a plurality of orifices or nozzles 116 toward print media 118 so as to print onto the print media 118. Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In some implementations, inkjet printhead assembly 102 and ink supply assembly 104 are housed together in an inkjet cartridge or pen. In other implementations, ink supply assembly 104 is separate from inkjet printhead assembly 102 and supplies ink to inkjet printhead assembly 102 through an interface connection, such as a supply tube. In either implementation, reservoir 120 of ink supply assembly 104 may be removed, replaced, and/or refilled. Where inkjet printhead assembly 102 and ink supply assembly 104 are housed together in an inkjet cartridge, reservoir 120 can include a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly. As such, mounting assembly 106 includes a carriage for moving inkjet printhead assembly 102 relative to media transport assembly 108 to scan print media 118. In another implementation, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

In one implementation, inkjet printhead assembly 102 includes one printhead 114. In another implementation, inkjet printhead assembly 102 is a wide-array, multi-head printhead assembly. In wide-array assemblies, an inkjet printhead assembly 102 typically includes a carrier that carries printheads 114, provides electrical communication between printheads 114 and electronic controller 110, and provides fluidic communication between printheads 114 and ink supply assembly 104.

In one embodiment, inkjet printing system 100 is a drop-on-demand thermal bubble inkjet printing system where the printhead(s) 114 is a thermal inkjet (TIJ) printhead. The TIJ printhead implements a thermal resistor ejection element in an ink chamber to vaporize ink and create bubbles that force ink or other fluid drops out of a nozzle 116. In another embodiment, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic printer controller 110 typically includes one or more processors 111, firmware, software, one or more computer/processor-readable memory components 113 including volatile and non-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters.

In one implementation, electronic controller 110 includes ACEO pump module 128 stored in a memory 113 of controller 110. ACEO pump module 128 includes coded instructions executable by one or more processors 111 of controller 110 to cause the processor(s) 111 to implement various functions related to the operation of ACEO pump 126. Thus, for example, ACEO pump module 128 executes to create AC electric fields within the fluidic micro-environment of an inkjet printhead 114 to generate a net fluid flow through micro-fluidic channels of the printhead 114. More specifically, the ACEO pump module 128 executes to control the timing, frequency and magnitude of AC voltage applied to 3-dimensional, stepped, electrodes within the printhead channels. Application of the AC voltage polarizes the electrodes and causes charge groups within the contacting fluid (i.e., ink) to migrate toward the electrode surfaces and be swept in specified directions through their interactions with localized electrode-edge fringe fields, as discussed below with respect to FIGS. 3 and 4. In different implementations, ACEO pump module 128 can execute to polarize the electrodes in different ways. For example, ACEO pump module 128 can execute to generate sine waves (e.g., from an AC power source) or square waves (e.g., from a digital circuit) to polarize the electrodes.

Figure 2A:
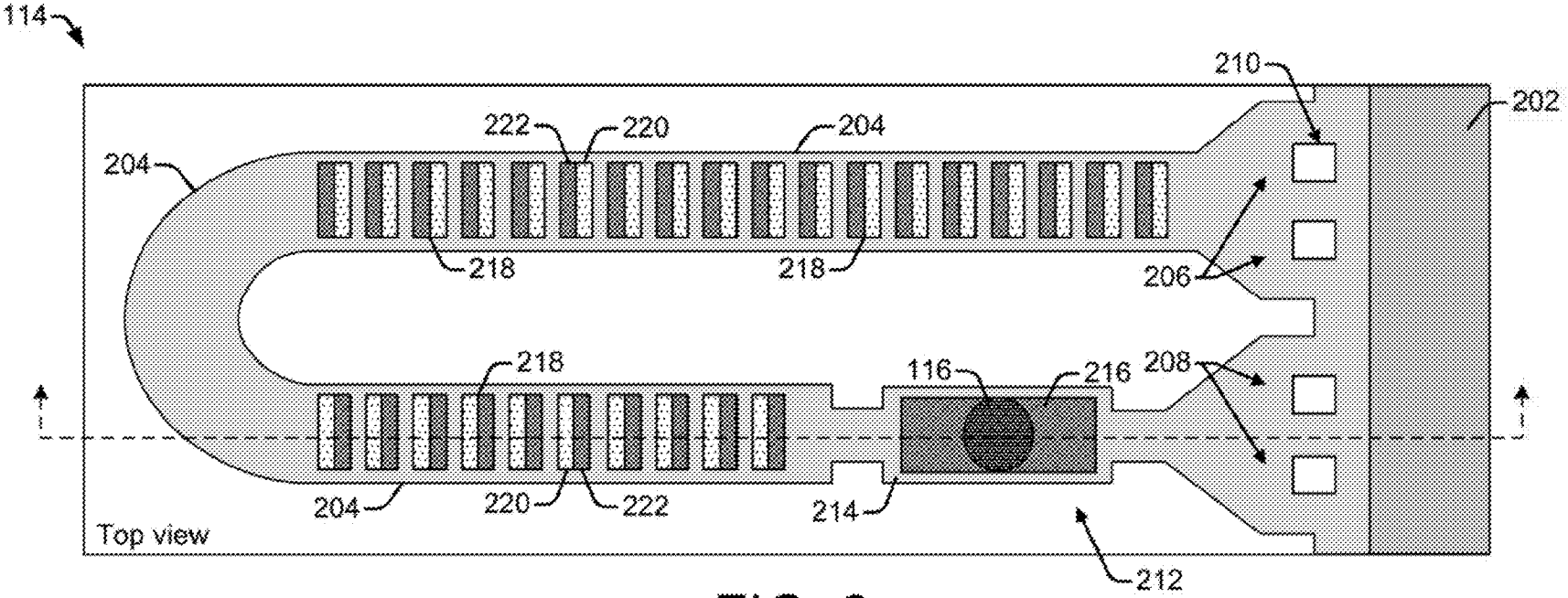
FIG. 2*a* shows a top view of a portion of an example fluid ejection device, according to an embodiment.
Figure 2B:
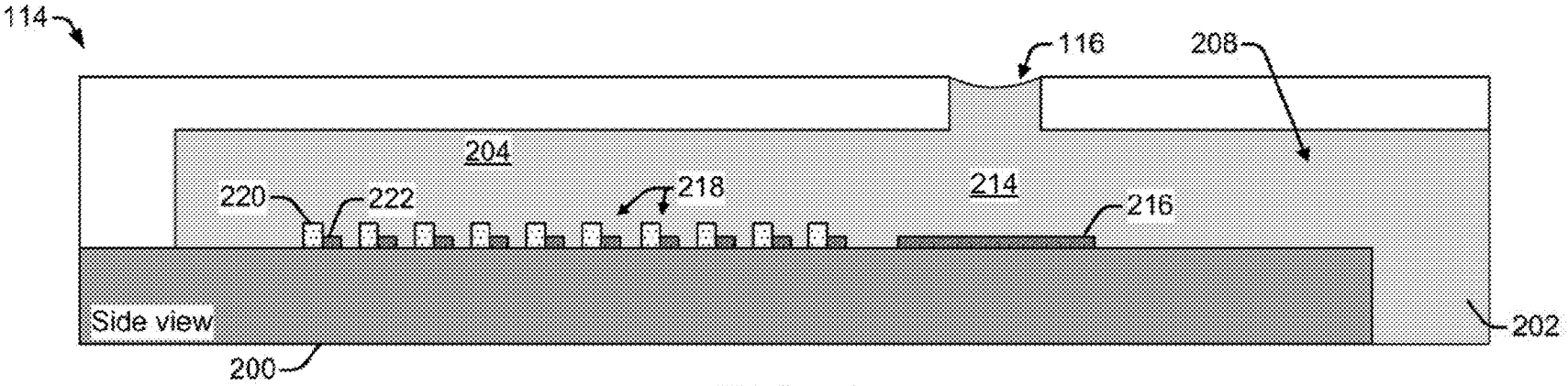
FIG. 2*b* shows a side view of a portion of an example fluid ejection device, according to an embodiment.

FIG. 2 shows a top view (FIG. 2*a*) and a side view (FIG. 2*b*) of a portion of an example fluid ejection device 114 (i.e., printhead 114), according to an embodiment of the disclosure. Printhead 114 includes a substrate 200 (e.g., glass, silicon) with a fluid slot 202 or trench formed therein. In general, fluid slot 202 and other features of printhead 114 are formed using various precision microfabrication techniques such as electroforming, laser ablation, anisotropic etching, sputtering, spin coating, dry etching, photolithography, casting, molding, stamping, machining, and the like. Referring again to FIG. 2, printhead 114 further includes a fluidic channel 204 that extends from the fluid slot 202 at a first end 206 of the channel, and back to the fluid slot 202 at a second end 208 of the channel 204. The first and second channel ends (206, 208) can be referred to as the channel inlet 206 and channel outlet 208, respectively, depending on the direction of fluid flow through the channel 204. In some implementations, printhead 114 also includes particle tolerant architectures 210. As used herein, particle tolerant architectures (PTA) refer to barrier objects placed in the fluid/ink path (e.g., channel inlet 206 and outlet 208) to prevent particles such as dust and air bubbles from interrupting ink or printing fluid flow. The PTAs 210 help prevent particles from blocking ejection chambers and/or nozzles 116.

Each channel 204 of printhead 114 includes a drop generator 212 to eject fluid drops out of the printhead. Each drop generator 212 includes a fluid ejection chamber 214 and associated nozzle 116. On the floor of each ejection chamber 214 is an ejection element 216 that activates to eject fluid from the chamber 214 through nozzle 116. In one implementation, ejection element 216 comprises a thermal resistor heating element. Activation of the thermal resistor to eject a fluid drop includes passing electrical current through the element, which heats the element and vaporizes a small portion of the fluid within the chamber 214. The formation of the vapor bubble forces a fluid drop through the nozzle 116. In another implementation, ejection element 216 comprises a piezoelectric material actuator. Activation of the piezoelectric material actuator to eject a fluid drop includes applying a voltage across a piezoelectric membrane which deforms the actuator, generating pressure pulses within the chamber 214 that force fluid drops out of the nozzle 116.

Each channel 204 of printhead 114 additionally includes an ACEO pump mechanism 126 that comprises a plurality of ACEO electrodes 218. The electrodes 218 are disposed on the floor of the channel 204 such that the electrode lengths extend across the channel width, between the sides of the channel 204. The electrode lengths (i.e., electrode "fingers") extend across the channel width such that the electrodes are orthogonal both to the length of the channel 204 and to the eventual net flow of fluid through the channel 204. As discussed further below with respect to FIG. 4, each electrode 218 comprises a 3-dimensional structure that includes a stepped electrode region 220 and a flat, or non-stepped electrode region 222.

Figure 3A:
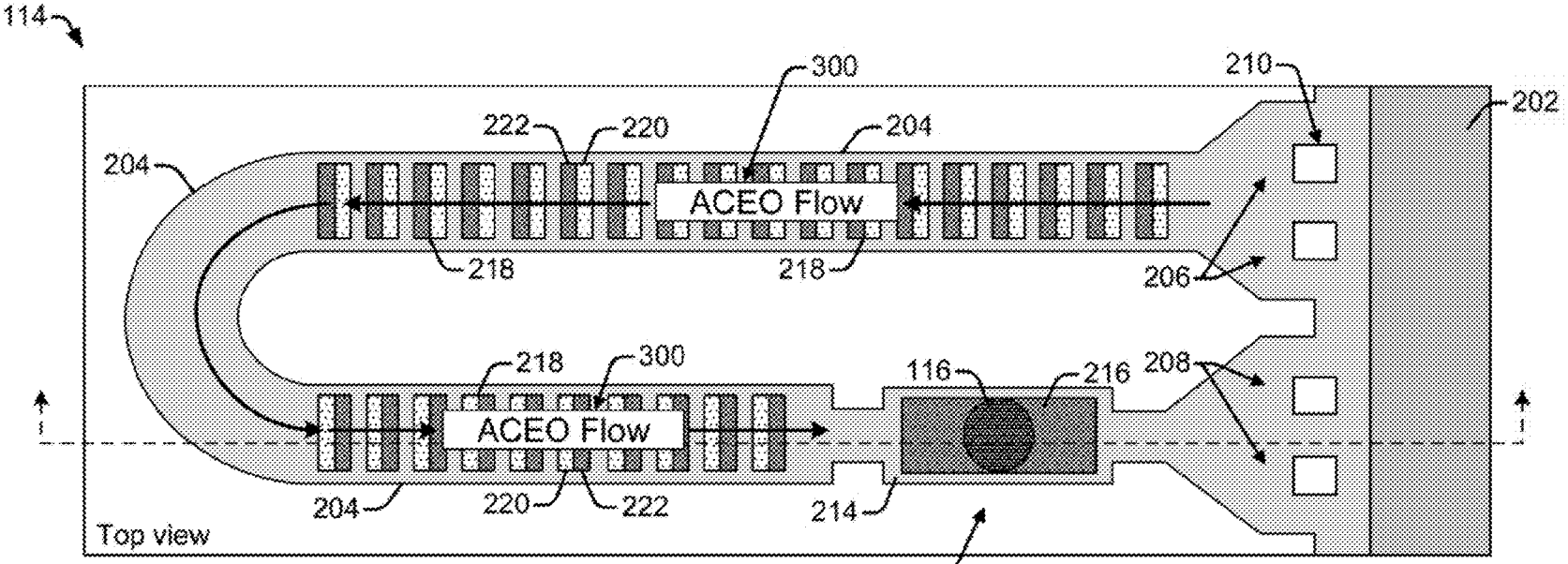
FIG. 3*a* shows a top view of a portion of an example fluid ejection device with an AC voltage being applied to ACEO electrodes, according to an embodiment.
Figure 3B:
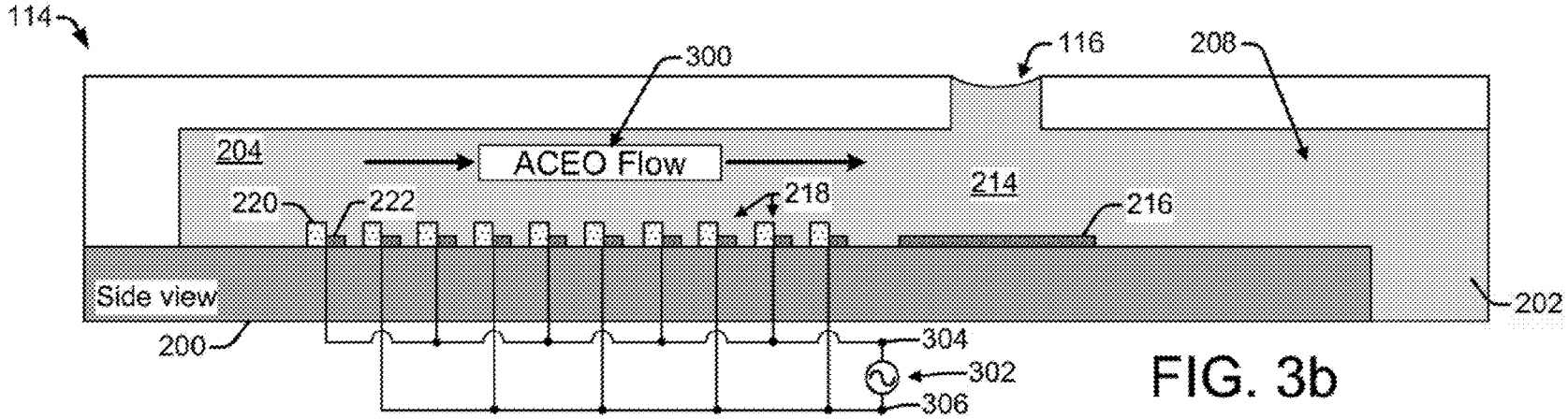
FIG. 3*b* shows a side view of a portion of an example fluid ejection device with an AC voltage being applied to ACEO electrodes, according to an embodiment.

FIG. 3 shows a top view (FIG. 3*a*) and a side view (FIG. 3*b*) of a portion of an example fluid ejection device 114 (i.e., printhead 114) with an AC voltage being applied to ACEO electrodes 218, according to an embodiment of the disclosure. The AC voltage used to actuate the ACEO electrodes 218 is typically a low voltage on the order of 1-3 Vpp, although other voltages are possible and contemplated by this disclosure. Application of the AC voltage polarizes the electrodes and generates a net fluid flow (i.e., ACEO Flow 300) through the printhead channel 204. More specifically, when AC voltage is applied to the electrodes 218 as shown in FIG. 3*b*, adjacent, interdigitated, electrode "fingers" are driven to opposite electrical polarities (i.e., 180° out of phase with one another). The opposite electrical polarities of the electrode fingers are switched repeatedly at the frequency of the applied AC voltage. Application of the AC voltage is achieved in part by coupling alternate "fingers" of the electrodes to different output terminals of the AC power source 302, as shown in FIG. 3. Thus, a first group of the electrodes 218 is coupled to a first output terminal 304 of the AC power supply 302, while another group of electrodes 218 that alternate with, or are interleaved between, the first group of electrodes 218, is coupled to a second output terminal 306 of the AC power supply 302. In addition, application of the AC voltage includes controlling the AC power supply 302 by executing coded instructions of ACEO pump module 128 with a processor(s) of controller 110. Such control includes, for example, controlling the frequency and magnitude of the AC voltage applied to electrodes 218.

Figure 4:
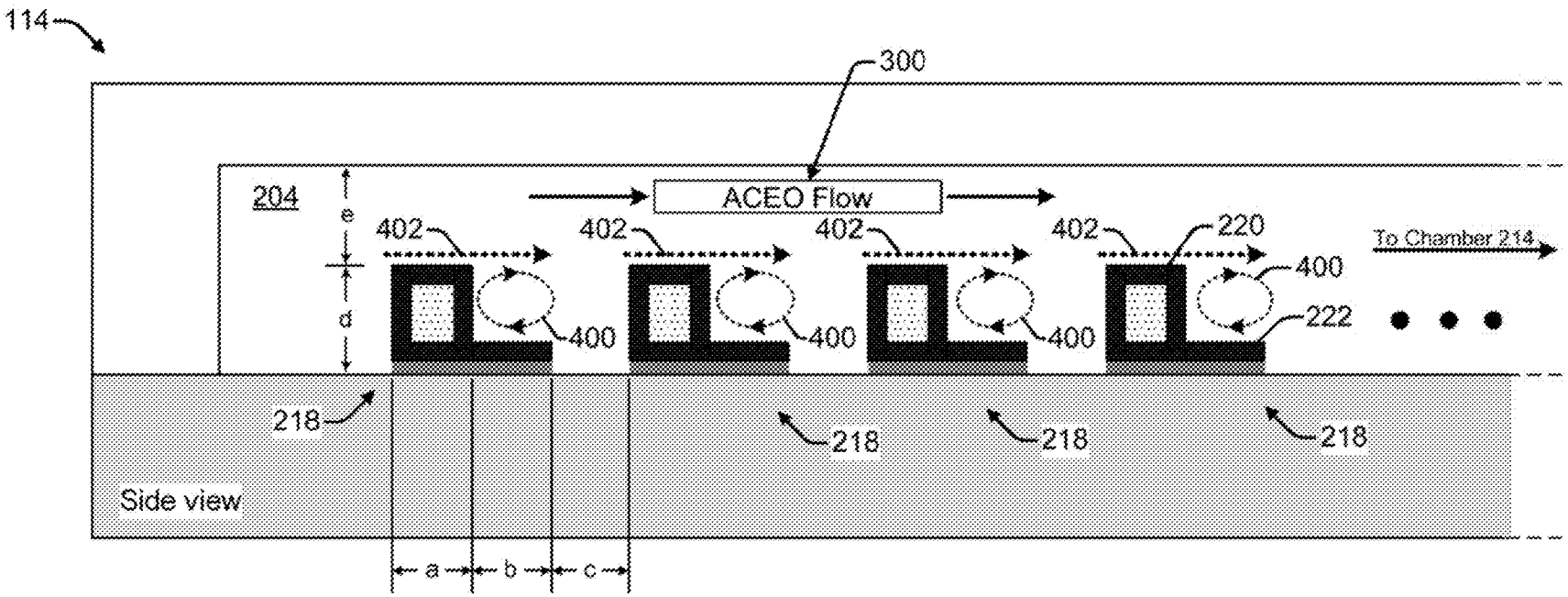
FIG. 4 shows an expanded side view of a section of a fluid ejection device that illustrates the 3-dimensional electrode structure of an ACEO pump within a channel, according to an embodiment.

FIG. 4 shows an expanded side view of a section of a printhead 114 that illustrates the 3-dimensional electrode structure of the ACEO pump 126 within a channel 204, according to an embodiment of the disclosure. The side view shown in FIG. 4 is generally the left portion of the side view of FIG. 3*b*. Thus, the channel side wall at the left of FIG. 4 corresponds with the channel side wall at the left of FIG. 3*b*, and the right side of the channel 204 in FIG. 4 continues on to the chamber 214 and fluid slot 202, as shown in FIG. 3*b*. When polarized, the electrodes 218 cause charge groups within the contacting fluid (i.e., ink) to migrate toward the electrode surfaces and be swept in specified directions through their interactions with localized electrode-edge fringe fields. In order for the charge groups within the ink to migrate and cause a net fluid flow (i.e., ACEO Flow 300) through the channel 204 in a common, prescribed, direction, the implementation of the electrodes 218 involves using 3-dimensionally stepped electrodes having interdigitated ladder topologies, where electrode "fingers" of opposite electrical polarity (i.e., 180° out of phase) interleave with one another. Each electrode finger in this interleaved pattern is comprised of two distinct height regions. A first height region in each electrode 218 is a stepped electrode region 220 having a first height. The stepped region 220 extends part way across the width of an electrode finger. A second height region in each electrode 218 is a non-stepped region 222, or flat region, having a second height. The non-stepped region 222 extends the remainder of the way across the width of the electrode finger.

The regions of different heights in the electrodes 218 (i.e., stepped region 220 and non-stepped region 222) in combination with the applied time dependent, polarity shifting signaling (e.g., the AC voltage from AC power source 302) form small fluid recirculation zones 400 (represented in FIG. 4 as elliptical dotted lines) along each step of each electrode 218 within the interdigitated ACEO ladder topology. As illustrated in FIG. 4, the top edge of each recirculation zone 400 rotates in a forward direction that is compatible with and contributes to the slip flow 402 (represented in FIG. 4 as a straight dotted line) which is native to the elevated, stepped region 220 of each electrode 218. The recirculation zone 400 is recessed below the stepped region 220 such that the stepped region 220 provides a physical shelter that prevents the bottom edge of each recirculation zone 400, which flows in a reverse direction, from competing against the slip flow 402 and the overall net ACEO fluid flow 300. As such, the slip flow 402 across the tops of the stepped regions 220 and the flow in the top edges of the recirculation zones 400 cooperate to collaboratively push fluid in a common direction. This cooperation in flows generates a net ACEO fluid flow 300 that is orthogonal to the orientation of the electrode fingers stationed within the channel 204. In addition, controlled variations in the AC voltage magnitude and frequency (i.e., by execution of ACEO pump module 128 in controller 110) can alter the slip flow 402 and the rotational flow in recirculation zones 400 to enhance the net ACEO fluid flow 300. The ACEO fluid flow 300 through the channel 204 and chamber 214 provides fresh ink to the fluid ejection nozzles that helps to offset decap behaviors noted above.

Varying the aspect ratios of the electrode 218 footprint within channel 204 impacts the degree of ACEO net flow through the channel 204. In some implementations, the aspect ratio of the electrodes 218 and their spacing within the channel 204 for the given dimensions a, b, c, d and e, as shown in FIG. 4, is approximately 1:1:1:1:1. The dimensions shown in FIG. 4 include; a, the width of the stepped region 220 of electrode 218; b, the width of the non-stepped region 222 of electrode 218; c, the space between adjacent electrodes in channel 204; d, the height of the stepped region 220 of electrode 218 from the floor of the channel 204 to the top edge of the stepped region 220; and e, the distance from the top edge of the stepped region 220 to the roof of the channel 204. In a particular example, where the height of the channel 204 is on the order of 10 microns, each of the dimensions a, b, c, d and e is approximately 5 microns. The 1:1:1:1:1 aspect ratio applied to these electrode dimensions and their spacing within channel 204 have been found to provide enhanced ACEO fluid flow 300 through the channel. However, the electrode dimensions and spacing within the channel 204 are not limited in this regard, and other aspect ratios that provide beneficial net flow are also contemplated by this disclosure.

As noted above, the features of printhead 114 can be formed using various precision microfabrication techniques such as electroforming, laser ablation, anisotropic etching, sputtering, spin coating, dry etching, photolithography, casting, molding, stamping, machining, and the like. Thus, the height of the stepped region 220 in electrode 218 can be formed by the deposition and processing of an SU8 material, for example, followed by the deposition and processing of a metal layer that covers the SU8 and forms the electrode metal of the non-stepped region 222 and the top, sides and bottom of the stepped region 220. In some implementations, the metal layer of electrodes 218 is formed of platinum and/or platinum family materials that provide beneficial protection of the electrode 218 against the corrosive effects of various ink chemistries. While platinum and platinum family materials are mentioned as candidates for the formation of electrodes 218, other suitable metal materials are also possible and are contemplated by this disclosure.

Figure 5:
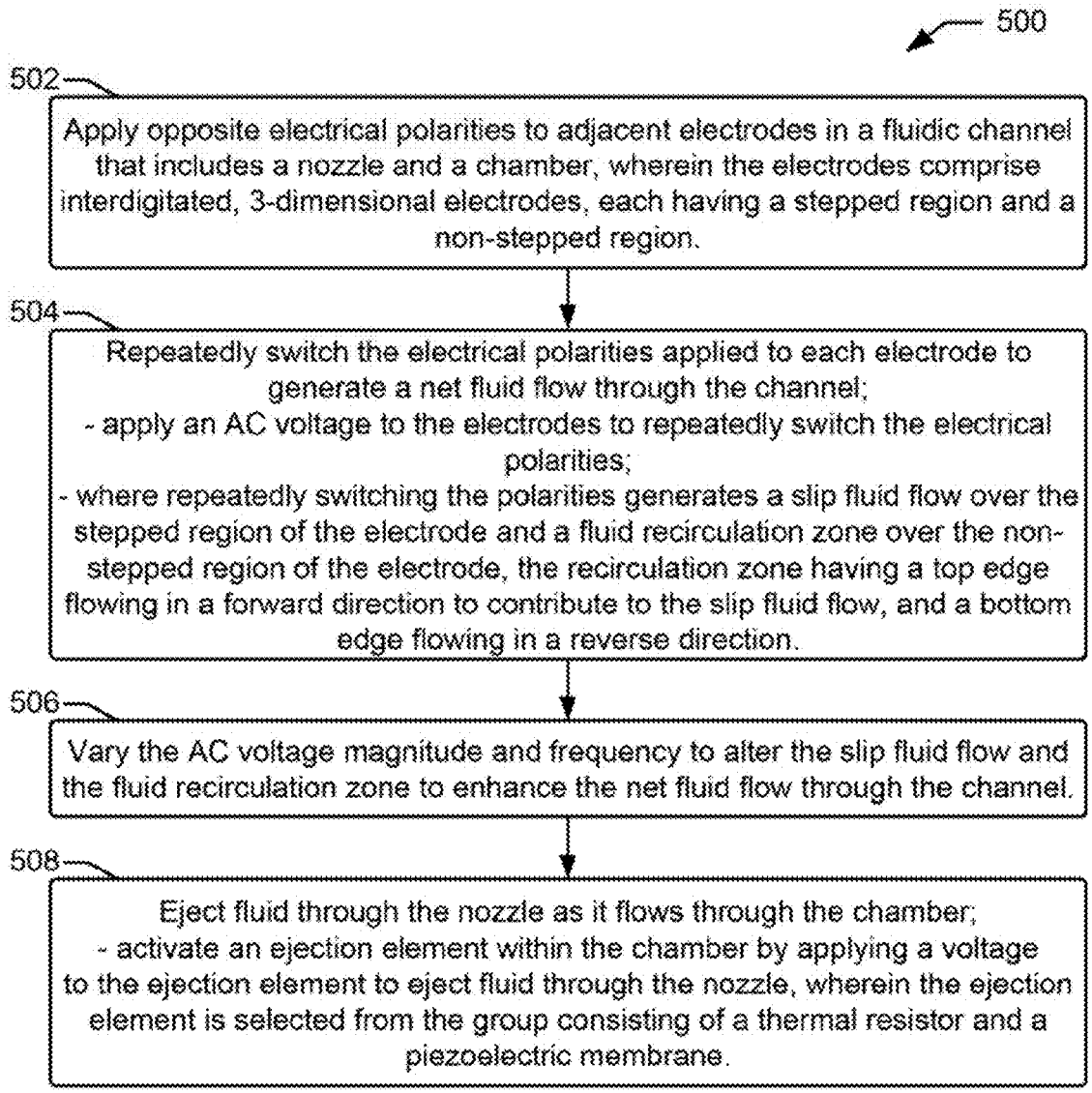
FIG. 5 shows a flowchart of an example method, according to an embodiment.

FIG. 5 shows a flowchart of an example method 500, according to an embodiment of the disclosure. Method 500 is related to a fluid ejection device 114 with an ACEO pump mechanism as discussed herein, and is associated with embodiments discussed above with respect to FIGS. 1-4. Details of the steps shown in method 500 can be found in the related discussion of such embodiments. The steps of method 500 may be embodied as programming instructions stored on a computer/processor-readable medium, such as a memory 113 of controller 110 as shown in FIG. 1. In an embodiment, the implementation of the steps of method 500 may be achieved by the reading and execution of such programming instructions by a processor, such as processor 111 as shown in FIG. 1. While the steps of method 500 are illustrated in a particular order, the disclosure is not limited in this regard. Rather, it is contemplated that various steps may occur in different orders than shown, and/or simultaneously with other steps.

Method 500 begins at block 502 where the first step shown is to apply opposite electrical polarities to adjacent electrodes in a fluidic channel. The channel includes a nozzle and a chamber, and the electrodes comprise interdigitated, 3-dimensional electrodes, each having a stepped region and a non-stepped region. At block 504, the next step of method 500 is to repeatedly switch the electrical polarities applied to each electrode to generate a net fluid flow through the channel. Repeatedly switching the electrical polarities comprises applying an AC voltage to the electrodes. In different implementations, a processor executing instructions from ACEO pump module 128 controls the switching of electrical polarities by controlling the generation of sine waves (e.g., from an AC power source) or square waves (e.g., from a digital circuit) to polarize the electrodes. In other implementations, the electrodes can be driven by a simple waveform generator coupled to the electrodes without processor control. Repeatedly switching the electrical polarities of the interleaved/interdigitated electrodes generates a slip fluid flow over the stepped region of the electrode and a fluid recirculation zone over the non-stepped region of the electrode. The recirculation zone has a top edge flowing in a forward direction to contribute to the slip fluid flow, and a bottom edge flowing in a reverse direction.

At block 506, the next step of method 500 is to vary the AC voltage magnitude and frequency to alter the slip fluid flow and the fluid recirculation zone to enhance the net fluid flow through the channel. At block 508 of method 500, the next step is to eject fluid through the nozzle as it flows through the chamber. Ejecting fluid through the nozzle comprises activating an ejection element within the chamber by applying a voltage to the ejection element. In different implementations the ejection element is selected from the group consisting of a thermal resistor and a piezoelectric membrane.

What is claimed is:

1. A fluid ejection device comprising:

a fluidic channel having first and second ends;

a drop generator disposed on a floor of the channel;

a fluid reservoir in fluid communication with the first and second ends; and an alternating-current electro-osmotic (ACEO) pump disposed on the floor of the channel to generate net fluid flow from the reservoir at the first end, through the channel, and back to the reservoir at the second end, wherein the ACEO pump has plural electrodes of a first AC polarity disposed alternatingly in the direction of net fluid flow with plural electrodes of an opposite AC polarity.

2. A fluid ejection device as in claim 1, wherein the ACED pump comprises a plurality of electrodes on a floor of the channel, each electrode extending lengthwise across a width of the channel and orthogonal to the direction of net fluid flow through the channel.

3. A fluid ejection device as in claim 1, wherein the drop generator comprises an ejection element selected from the group consisting of a thermal resistor and a piezoelectric membrane.

4. A fluid ejection device as in claim 1, wherein the ACEO pump is disposed in the channel on only one side of the drop generator.

5. A fluid ejection device comprising:

a fluidic channel having first and second ends;

a drop generator disposed within the channel;

a fluid reservoir in fluid communication with the first and second ends; and an alternating-current electro-osmotic (ACEO) pump disposed within the channel to generate net fluid flow from the reservoir at the first end, through the channel, and back to the reservoir at the second end, wherein the pump has a plurality of electrodes each extending lengthwise across a width of the channel and orthogonal to the direction of net fluid flow through the channel, the plurality of electrodes including a first group of electrodes coupled to a first terminal of an AC power source and a second group of electrodes coupled to a second terminal of the AC power source, wherein electrodes from the first group are interleaved among electrodes from the second group in an alternating manner.

6. A fluid ejection device comprising:

a fluidic channel having first and second ends;

a drop generator disposed within the channel;

a fluid reservoir in fluid communication with the first and second ends; and an alternating-current electro-osmotic (ACEO) pump disposed within the channel to generate net fluid flow from the reservoir at the first end, through the channel, and back to the reservoir at the second end, wherein the pump has a plurality of electrodes each extending lengthwise across a width of the channel and orthogonal to the direction of net fluid flow through the channel, each electrode having a stepped region extending across a first width of the electrode, and a non-stepped region extending across a remaining width of the electrode.

7. A fluid ejection device as in claim 6, wherein width dimensions of the stepped and non-stepped regions across the electrode are substantially equal.

8. A fluid ejection device as in claim 7, wherein spacing between the electrodes is substantially equal to the width dimensions of the stepped and non-stepped regions of the electrodes.

9. A fluid ejection device as in claim 7, wherein the stepped region has a height dimension extending from the floor of the channel to a top edge of the stepped region that is substantially equal to the width dimensions of the stepped and non-stepped regions of the electrodes.

10. A fluid ejection device as in claim 9, wherein the channel comprises a channel height between its floor and roof and the height dimension of the stepped region of the electrodes is substantially equal to one half of the channel height.

11. A fluid ejection device as in claim 6, wherein an aspect ratio of the width of the stepped region, the width of the non-stepped region, the distance between adjacent electrodes in the channel, the height of the stepped region from the floor of the channel to a top edge of the stepped region, and a distance from the top edge of the stepped region to the roof of the channel, is approximately 1:1:1:1:1.

12. A processor-readable medium storing code representing instructions that when executed by a processor cause the processor to:

apply opposite electrical polarities to adjacent electrodes in a fluidic channel that includes a nozzle and a chamber, wherein the electrodes comprise interdigitated, 3-dimensional electrodes, each having a stepped region and a non-stepped region;

repeatedly switch the electrical polarities applied to each electrode to generate a net fluid flow through the channel; and eject fluid through the nozzle as it flows through the chamber.

13. The processor-readable medium of claim 12, wherein repeatedly switching the electrical polarities comprises applying a waveform to the electrodes selected from the group consisting of an AC sine waveform and a square waveform.

14. The processor-readable medium of claim 13, wherein repeatedly switching the electrical polarities generates a slip fluid flow over the stepped region of the electrode and a fluid recirculation zone over the non-stepped region of the electrode, the recirculation zone having a top edge flowing in a forward direction to contribute to the slip fluid flow, and a bottom edge flowing in a reverse direction.

15. The processor-readable medium of claim 14, wherein the instructions further cause the processor to vary the AC voltage magnitude and frequency to alter the slip fluid flow and the fluid recirculation zone to enhance the net fluid flow through the channel.

16. The processor-readable medium of claim 12, wherein the instructions further cause the processor to activate an ejection element within the chamber by applying a voltage to the ejection element to eject fluid through the nozzle.

17. The processor-readable medium of claim 16, wherein the ejection element is selected from the group consisting of a thermal resistor and a piezoelectric membrane.

* * * * *